United States Patent [19]

Humphreys et al.

[11] 4,114,805

[45] Sep. 19, 1978

[54] THERMAL DAMPER ASSEMBLY

[76] Inventors: Wesley G. Humphreys, 1070 Randolph Rd., Meadowbrook, Pa. 19046; Edward Camillo, 20 South Michigan Ave., Atlantic City, N.J. 08401

[21] Appl. No.: 767,065

[22] Filed: Feb. 9, 1977

[51] Int. Cl.[2] ..... G05D 23/12

[52] U.S. Cl. ..... 236/1 G; 126/285 R; 236/101 D

[58] Field of Search ..... 126/285 R, 287.5; 98/40 VT; 236/1 G, 49, 93 R, 101 D; 137/601

[56] References Cited

U.S. PATENT DOCUMENTS

| | | | |
|---|---|---|---|
| 3,528,606 | 9/1970 | Witten | 236/49 |
| 3,777,974 | 12/1973 | Sparks | 236/49 |
| 3,921,900 | 11/1975 | Cole | 236/93 R |

FOREIGN PATENT DOCUMENTS

| | | | |
|---|---|---|---|
| 1,071,316 | 12/1959 | Fed. Rep. of Germany | 236/93 |
| 822,480 | 10/1959 | United Kingdom | 236/93 |

*Primary Examiner*—Ronald C. Capossela

*Attorney, Agent, or Firm*—John W. Logan, Jr.

[57] ABSTRACT

A damper assembly for conserving fuel consumption in a heating furnace comprises baffle means pivotally mounted in support means arranged to fit in an outlet flue communicating between the furnace and a chimney stack so that the baffle means is movable between a fully open position whereby the flow of combustion gases from the furnace to the stack is substantially unimpeded and a fully closed position providing a restricted flow path for the gases whereby the gas flow to the stack is reduced. Associated wth the baffle means is thermostatic control means responsive to the temperature of the combustion gases for moving the baffle means to the fully open position at a relatively low temperature indicating that the furnace is inoperative and for moving the baffle means to the fully closed position at a relatively high temperature indicating that the furnace is operative. Thus, when the furnace is inoperative, the gases from the furnace can escape, but when the furnace is operative, the escape of combustion gases is impeded, retention time of the gases in the furnace is increased and the loss of useful heat energy is reduced. Accordingly, less fuel need be used.

21 Claims, 5 Drawing Figures

THERMAL DAMPER ASSEMBLY

This invention relates to automatic damper assemblies and, more particularly, to automatic damper assemblies for conserving the use of fuel in a heating furnace.

In conventional heating furnaces a considerable amount of useful heat energy provided by the burner escapes through the chimney. For example, in one typical heating installation it has been determined that the combustion gases have a temperature of 550° F. in the furnace and that the temperature of these gases in the chimney is about 505° F. With such a large loss of useful heat energy through the chimney, a considerable amount of fuel is utilized to maintain the desired temperature in the furnace.

It is, therefore, a primary object of this invention to provide an assembly for restricting the loss of useful heat energy from a heating furnace through its associated chimney in order to conserve the use of fuel. It is a further object of this invention to provide a relatively inexpensive damper assembly restricting the flow of combustion gases from the furnace to a chimney stack for increasing the retention time of the hot combustion gases in the furnace. It is an even further object of this invention to provide a damper assembly operative automatically when the furnace is operative to restrict the flow of combustion gases from the furnace to the chimney. Finally, it is an object of this invention to provide a damper assembly that is responsive to sudden pressure increases caused by blasts or explosions in the furnace for removing the restriction to quickly vent the combustion gases to the chimney.

These and other objects of this invention are accomplished by providing a damper assembly comprising baffle means and support means in which said baffle means is carried. The support means is arranged to be connected to a generally horizontal outlet flue communicating between the furnace and a chimney stack with the baffle means being located within the circumference of the support means and, thus, the flue. The baffle means is pivotally mounted to the support means for movement between an open position wherein the flow path for the combustion gases from the furnace to the chimney is generally unimpeded and a closed position providing a restricted flow path for the combustion gases. Operatively associated with the baffle means is control means responsive to the temperature of combustion gases from the furnace for moving the baffle means to its fully open position at a relatively low temperature indicating that the furnace is not operating and to the closed position at a relatively high temperature indicating that the furnace is operating whereby heat is retained in the furnace during its operation because of the restricted flow path.

More particularly, the baffle means includes pressure relief means, preferably, in the form of free-swinging louvers arranged such that when the baffle means is in its closed position, the louvers are in a closed position and when the baffle means is in its fully open position, the louvers are also in a generally open position. Thus, in the event of a blast, an explosion or other pressure buildup in the furnace, the louvers are pivoted by the additional pressure to an open position allowing the pressure in the furnace to vent through the chimney.

For a better understanding of the invention, reference is made to the following description of a preferred embodiment thereof, taken in conjunction with the figures of the accompanying drawing, in which.

Figure 1:
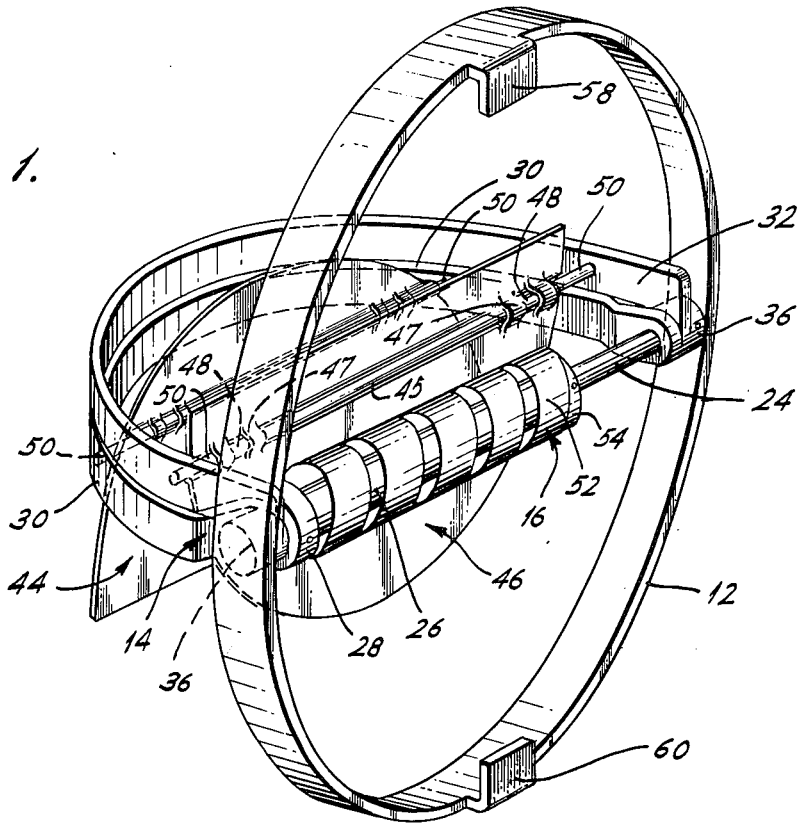
FIG. 1 is a perspective view of a first embodiment of a damper assembly in accordance with this invention.
Figure 2:
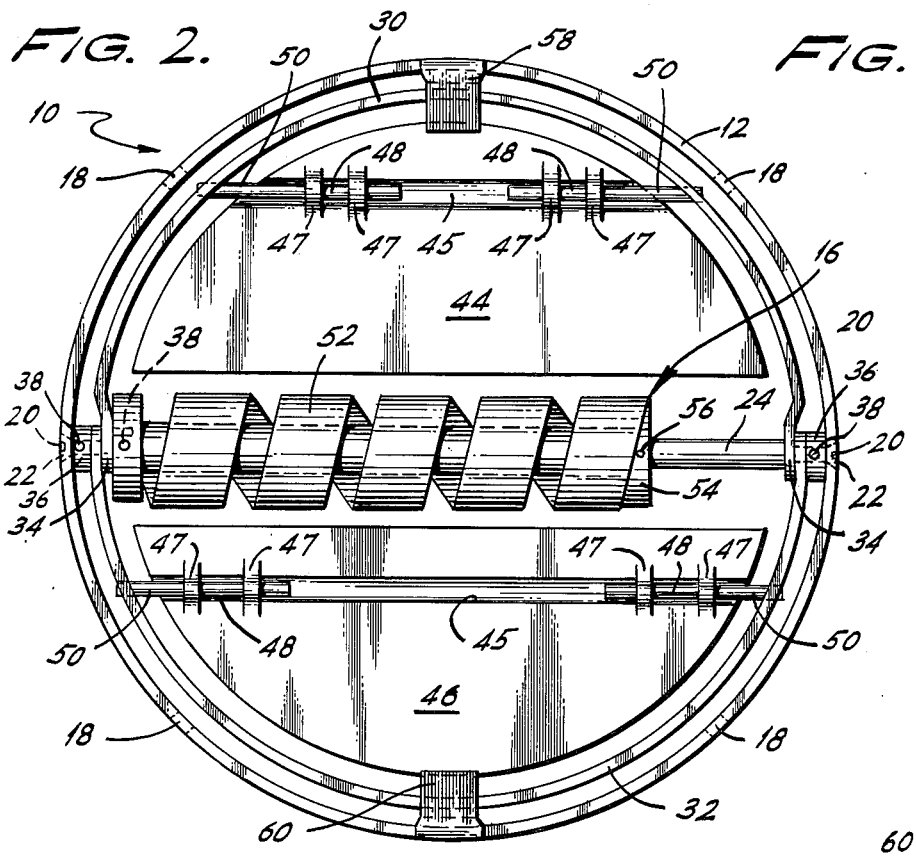
FIG. 2 is a side plan view of the damper assembly illustrated in FIG. 1, showing the baffle means in a closed position.
Figure 3:
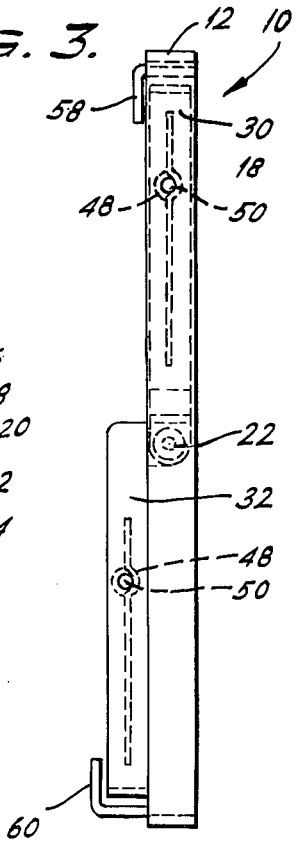
FIG. 3 is a side elevation of the damper assembly illustrated in FIGS. 1 and 2 with the control means omitted for the sake of clarity.

Referring now to the drawings, there is illustrated in FIGS. 1 and 2 a first embodiment of a damper assembly 10 in accordance with this invention. The damper assembly 10 includes support means in the form of a generally annular support ring 12 of relatively short axial length in which is carried a baffle assembly 14 pivotally arranged for pivotal movement between an open position as illustrated in FIG. 1 of the drawing and a closed position as illustrated in FIG. 2 of the drawing. Controlling the movement of the baffle assembly between the open and closed positions is a control means 16 which is responsive to the temperature of combustion gases flowing through the damper assembly.

In use, the damper assembly 10 is located in a generally horizontally arranged cylindrical flue (not illustrated) receiving combustion gases from a furnace (not illustrated) which gases flow from the furnace, through the flue to a chimney stack (not illustrated) so that the combustion gases are discharged to the atmosphere. It should be understood that the use of a generally horizontal flue between the furnace and the chimney stack is conventional in the art and need not be illustrated or explained in any detail.

The inner diameter of the support ring 12 is slightly larger than the outer diameter of the flue with which it is to be used so that when installed the free ends of the flue are received within the support ring 12. A plurality of tapped holes 18 extend through the ring in a generally radial direction and receive threaded screws which secure the support ring to the flue. At diametrically opposite points on the support ring 12 there are formed countersunk holes 20,20 which cooperate with suitable fasteners 22,22 of the flush head type to rotatably mount an inner shaft 24 which extends across the ring. The inner shaft 24 has a length just slightly less than the inner diameter of the support ring 12 and has formed in its end faces a threaded opening which receives the threaded shank portions of the fasteners 22,22. Since the frusto-conical bearing surface under the head of the fasteners 22,22 can rotate in the countersunk holes 20,20, the inner shaft is rotatably mounted in the support ring 12. Rotatably carried on the inner shaft 24 is an outer sleeve 26 having a length less than that of the inner shaft 24 and having a bushing 28 welded to or otherwise fixed to one end.

Mounted on the inner shaft 24 are upper and lower yoke members 30 and 32, respectively, each of which is generally semicircular in plan view. The upper yoke member 30 has its free ends 34,34 offset inwardly toward each other and formed with openings through which the inner shaft 24 extends such that the shaft and the upper yoke member are rotatable relative to each other. The lower yoke member 32 has openings formed in its free ends each of which has a collar 36 welded or otherwise fixedly secured thereto. The collars 36,36 are also formed with openings aligned with the openings in the free ends of the lower yoke member so that the inner shaft 24 extends through the openings. At this point, it is noted that the collars 36,36 are formed with suitable threaded openings receiving set screws 38,38 so that the lower yoke member 32 is keyed to the inner shaft 24 for rotation therewith. In addition, it is noted that the bushing 28 is formed with a threaded opening extending from one face thereof to the other for receiving a set screw 40 that bears on the adjacent face of a free end 34 of the upper yoke member 30 so that the upper yoke member is keyed to the sleeve 26 for rotation therewith.

The upper yoke member 30 pivotally carries a louver 44 and the lower yoke member 32 pivotally carries a louver 46. The louvers 44 and 46 are made of sheet metal, are generally semicircular in plan view and are of a size to fit within their respective yoke members with a clearance space between the louvers and the yoke members and also between the straight edges of the louvers. Adjacent their upper ends as viewed in the drawing, each louver is formed with an arcuate depression 45 extending parallel to the straight edges of the louvers and with struck-out strap portions 47 forming a pair of sockets 48,48 on each louver. When viewed along the axis of the depression 45 each socket 48 is in the form of a generally circular opening in which is received one end of a pivot pin 50 so that relative rotation between the louvers and pivot pins is normally precluded. At their other ends the pivot pins 50 are rotatably received in openings formed in the yoke members 30 and 32. Thus, the louvers are mounted for free swinging movement relative to the yoke members.

At this point it should be understood that the yoke members 30 and 32 and the louvers 44 and 46 form the baffle assembly 14 and that the open position is provided when the yoke members extend generally parallel to a line extending through the center of the support ring 12 and thus parallel to the flow path of the combustion gases through the flue. In this embodiment of the invention the yoke members 30 and 32 are in a generally horizontal plane. The closed position of the baffle assembly is provided when the yoke members 30 and 32 extend across the plane defined by the periphery of the support ring 12, that is, when the yoke members are concentric with respect to the support ring. It should further be understood that in the closed position of the baffle assembly 14, the louvers 44 and 46 also extend across the plane defined by the periphery of the support ring 12, that is, the louvers are concentric with respect to the support ring. In the embodiment of the invention disclosed herein, the yoke members 30 and 32 are in a vertical plane.

It can be seen with reference to the drawing, that the outer diameter defined by the upper and lower yoke members 30 and 32 is smaller than the inner diameter of the support ring 12 so that when the baffle assembly 14 is in the closed position a flow path between the outer periphery of the yoke member and the inner diameter of the support ring is provided. In addition, it can be seen that the diameter defined by the arcuate edges of the louvers 44 and 46 is less than the inner diameter defined by the upper and lower yoke members 30 and 32 so that when the baffle assembly 14 is in the closed position, a flow path is provided between the arcuate edges of the louvers and the inner periphery of the yoke members. An additional flow path is provided between the straight edges of the louvers 44 and 46 when the baffle assembly 14 is in the closed position.

As noted previously, the yoke members 30 and 32 extend parallel to the flow path of the combustion gases through the flue and support ring 12 and thus lie in a horizontal plane when the baffle assembly 14 is in the open position. Thus arranged, the obstruction to flow presented by the baffle assembly 14 is minimal and the flow of combustion gases is generally unimpeded. It is noted, however, that the louvers 44 and 46, being freely pivoted to the yoke members 30 and 32, respectively, will depend downwardly from their yoke member in a vertical position, but their obstruction to flow is not significant.

In the embodiment of the invention disclosed herein, the control means 16 includes a bimetallic helical spring 52 which is responsive to temperatures on the inlet side of the support ring, that is, to the temperatures of the combustion gases as exhausted from the furnace. One end of the spring 52 is fixed to the bushing 28 and the other end is fixed to a bushing 54 formed with a threaded opening receiving a set screw 56 for keying the bushing 54 to the inner shaft 24 for rotation therewith.

In use, the damper assembly 10 is installed in a generally horizontal flue as noted previously, and is arranged with the inner shaft 24 and sleeve 26 in a generally horizontal plane with the bimetallic helical spring 52 able to sense the temperature of combustion gases discharged from the furnace. When exposed to relatively high temperature combustion gases from the furnace indicating that the furnace is operating, the spring 52 will expand causing the bushings 28 and 54 to rotate in opposite directions. As the bushing 28 rotates the sleeve 26 also rotates and since the bushing is keyed to the upper yoke member 30 through the set screw 42, the upper yoke member rotates from its open position to its closed position. The louver 44, of course, moves with the upper yoke member 30. As the bushing 54 rotates, the inner shaft 24 rotates and since the shaft is keyed to the lower yoke member 32 through the collars 36,36 and set screws 38,38, the lower yoke member 32 rotates from its open to its closed position carrying with it the louver 46. Thus, the flow of combustion gases when the furnace is operating, is restricted through the flow paths between the support ring 12 and the yoke members 30 and 32 and between the yoke members and the louvers 44 and 46 and between the straight edges of the louvers. By impeding the flow of the combustion gases, the retention time of the gases in the furnace is increased significantly so that useful heat energy is retained for a longer period of time and the burner may be throttled to utilize less fuel. As seen in the drawing, a pair of stop members are located at diametrically opposite positions along the support ring 12 and the upper stop 58 prevents movement of the upper yoke member 30 beyond its closed position and the lower stop 60 prevents movement of the lower yoke member 32 beyond its closed position. Thus, if the temperature increases beyond that of the temperature driving the yoke members 30 and 32 to their fully closed position, further movement of the yoke members is prevented. In the event of a blast, explosion or other event causing a sudden pressure increase within the furnace, the free swinging louvers 44 and 46 are pivoted about the pivot pins 50 to permit a generally unrestricted flow of combustion gases through the support ring 12.

When the furnace is not operating and the temperature of the combustion gases decreases, the bimetallic helical spring 52 contracts causing the bushings 28 and 54 to again rotate in opposite directions, each rotating in a direction opposite that when the temperature increases, pivoting the yoke members to the open position. In the open position, the flow of combustion gases from the furnace is generally unimpeded so that the combustion gases are vented and so that a proper draft is maintained through the furnace.

Figure 4:
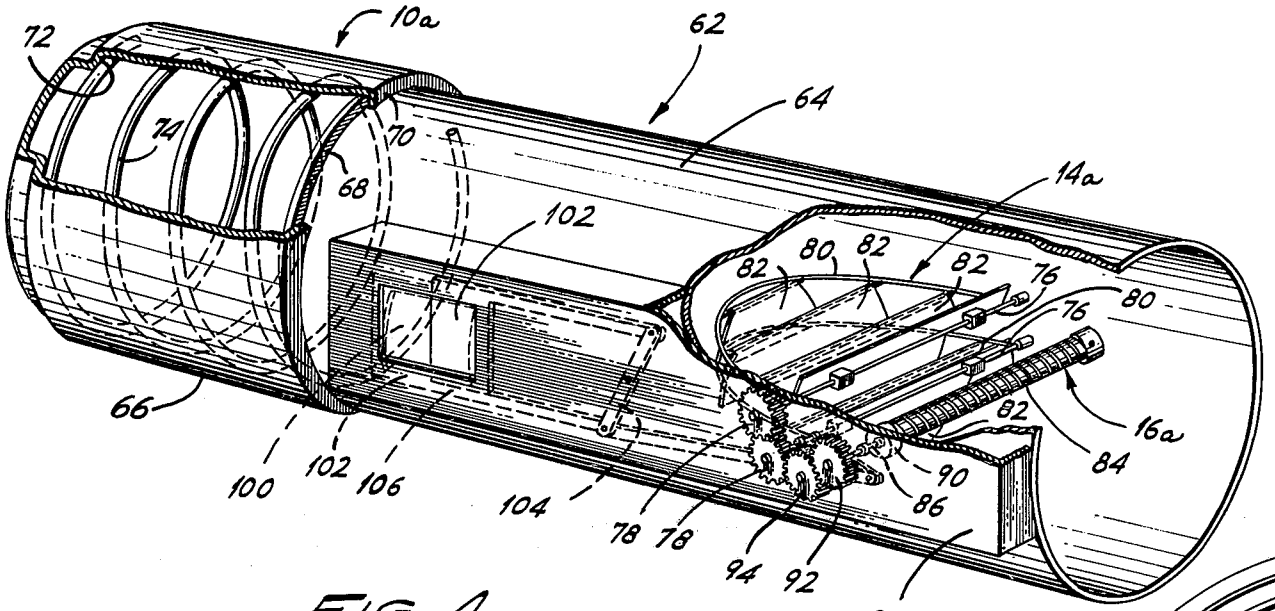
FIG. 4 is a perspective view of a damper assembly in accordance with another embodiment of this invention with portions thereof broken away for the sake of clarity; and, FIG. 3 is a plan view of the damper assembly illustrated in FIG. 4.
Figure 5:
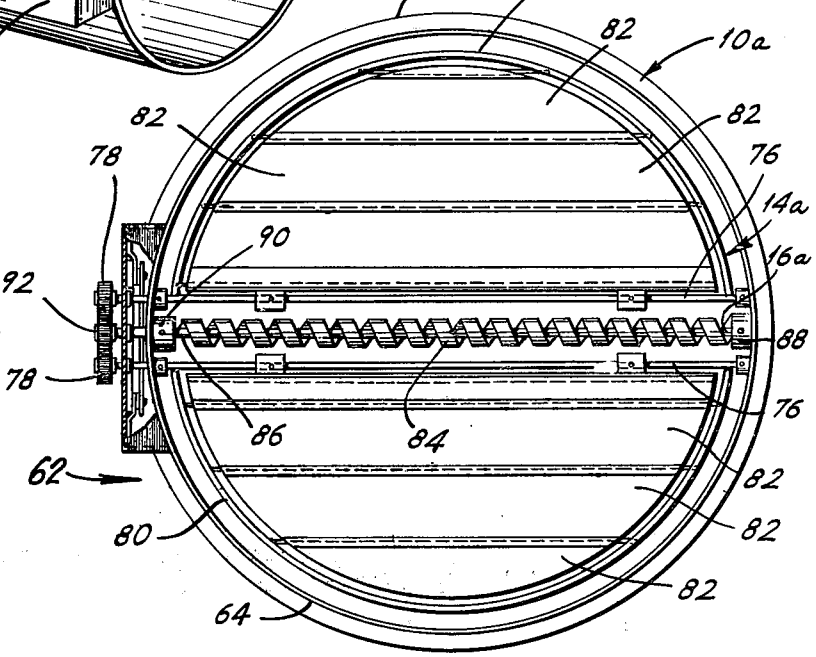

Referring next to FIGS. 4 and 5 of the drawing, there is illustrated another embodiment of a damper assembly 10*a* in accordance with the invention which includes support means in the form of a sleeve assembly 62, a baffle assembly 14*a* and a control means 16*a*. The sleeve assembly 62 is arranged to fit between sections of a generally horizontal flue located between a furnace and a chimney stack and comprises an inner cylindrical sleeve 64 and an outer cylindrical sleeve 66 concentrically and telescopically received about the inner sleeve. An external lip 68 is formed about one end of the inner sleeve 64 and serves as a stop for a lip 70 formed on the outer sleeve 66 whereby the inner sleeve and outer sleeves are retained in assembled relationship. Adjacent its other end, the outer sleeve 66 includes an inwardly projecting shoulder 72 and a spring member 74 bearing between the lip 68 and the shoulder and functions to lightly bias the sleeves apart to a fully extended position relative to each other. When inserting the sleeve assembly 62 in the flue, a section of the flue slightly smaller than the axial length of the sleeve 64 is first removed, then the free end of the sleeve 64 is fitted around the end of the upstream section of the flue to telescopically receive that end of the flue. The sleeves 64 and 66 are compressed against the force of the spring 74 and when the sleeve 66 is aligned with the level of the downstream section of the flue, the compression force is released so that the sleeve 66 fits around that end of the flue.

As clearly seen in the drawing, the baffle assembly 14*a* includes a pair of generally parallel shafts 76,76 journalled at one end to the inner wall of the sleeve 64 and extending at the other end through the side of the sleeve. On the end of each shaft 76 extending beyond the sleeve 64 is a gear 78. Inside the sleeve 64 each shaft carries a yoke member 80 which is fixed to the associated shaft for movement therewith. Each yoke member 80 carries a plurality of free swinging louvers 82. Similar to the embodiment disclosed in FIGS. 1 and 2 of the drawing the louvers 82 are pivoted to the yoke members adjacent their upper ends for free swinging movement with respect to the yoke members.

Since the shafts 76,76 are journalled, they along with the yoke members 80,80 and louvers 82 are movable to provide an open and closed position for the baffle assembly 14*a*. In the open position the yoke members 80,80 extend generally parallel to the flow path of the combustion gases through the sleeve assembly 62 so that the flow of gases is generally unimpeded. In this embodiment of the invention the yoke members 80,80 are in a generally horizontal plane when the baffle assembly 14*a* is in the open position. In the closed position the yoke members 80,80 extend across the plane defined by the sleeve 64, that is across the flow path of the combustion gases through the sleeve assembly. In this embodiment of the invention the yoke members 80,80 and the louvers 82 are in a generally vertical plane when the baffle assembly 14*a* is in the closed position. The yoke members 80,80 are generally semicircular in plan view and have a radius smaller than that of the sleeve 64 so that a restricted flow path for combustion gases is provided between the inner surface of the sleeve and the outer surface of the yoke members.

The control means 16*a* for moving the yoke members 80,80 between their open and closed positions is located on the inlet side of the baffle assembly 14*a* and includes a bimetallic helical spring 84 carried on a shaft 86 journalled through the sleeve 64. A first bushing 88 is fixed to the wall of the sleeve 64 and a second bushing 90 is fixed to the shaft by a set screw for rotation therewith. The ends of the spring 84 are fixed to the bushings 88 and 90. One end of the shaft 86 extends through the wall of the sleeve and the extension of the shaft carries a drive gear 92 in making engagement with an idler gear 94 which, in turn is in meshing engagement with the gears 78,78.

As the temperature of the combustion gases increases when the furnace is operating, the bimetallic helical spring 84 expands driving the bushing 90 which drives the shaft 86 and the driver gear 92. As the driver gear 92 rotates it drives the idler gear 94 which drives the gears 78,78, the shafts 76,76 and the yokes 80,80 to the closed position. Similar to the embodiments of FIGS. 1 and 2, should blast, explosion or other sudden pressure increase occur in the furnace, the louvers 82 are swung to their open position permitting the rapid exhaust of the gases. When the temperature in the furnace decreases indicating that the furnace is not operating, the bimetallic helical spring 84 contracts driving the bushing 90 in the opposite direction causing the yoke members 80,80 and their associated louvers 82 to swing to the open position wherein the exhaust of the combustion gases from the furnace is generally unimpeded.

If desired, in this embodiment of the invention, the baffle assembly 14*a* can be associated with a check damper assembly arranged to be in an open position when the furnace is operating and in a closed position when the furnace is not operating. The check damper assembly includes a closed housing 96 formed with an opening 98 that communicates with an opening 100 in the sleeve 64. For opening and closing the opening 98 there are provided a pair of damper plates 102 and 104. A dog-shaped link 106 is fixed to an eccentric pin on the drive gear 92 so that the link is reciprocated in a line parallel to the longitudinal axis of the sleeve member 64. At its free end, the dog leg link 106 carries the damper plate 102 so that the damper plate reciprocates with the link. Between its ends, the dog leg link 106 is connected to a cross linkage 108 pivoted intermediate its ends as shown and carrying at its other end a reciprocating link 110 attached to the other damper plate 104. Thus, as the yoke members are moved, the damper plates 102 and 104 are moved toward and away from each other to open or close the opening 98 in the closed housing 96. Accordingly, as the baffle assembly 14*a* moves from its closed to its open position, the damper plates 102 and 104 move from their open to closed position and conversely when the baffle assembly moves from its closed position to its open position, the damper plates move from their closed position to their open position. Thus, a proper draft is maintained through the flue.

If desired, the bimetallic helical springs disclosed in this application may be replaced by a suitable temperature sensing probe, for example, a thermocouple, and a small electric motor controlled by the probe and driving the baffle assembly between its open and closed positions.

From the preceding description of several embodiments of the invention it can be seen that less fuel is used in a heating furnace because the retention time of the combustion gases in the furnace is increased due to the restricted flow path provided by the baffle assembly. For example, in the typical heating installation previously referred to, including a damper assembly in accordance with this invention, the temperature of the combustion gases was 600° F. in the furnace and the temperature of these gases in the chimney was determined to be about 220° F. Clearly, the loss of useful heat energy is reduced. In addition it can be seen that the use of free swinging louvers enables the combustion gases to be vented in the event of a blast, or an explosion or other sudden pressure increase. By constructing the baffle assembly with yokes and louvers of a smaller dimension than the flue, the baffle assembly is foolproof in that the restricted flow path is always provided and cannot be inadvertently sealed by the baffle assembly. Finally, it can be seen that the damper assembly in accordance with this invention is relatively simple, rugged and economical.

While in the foregoing there have been disclosed several embodiments of the invention, it should be understood to those skilled in the art that various changes and modifications can be made without departing from the spirit and scope of the invention as recited in the appended claims.

We claim:

1. A damper assembly for conserving fuel consumption in a furnace comprising baffle means and support means in which said baffle means is located, said support means being arranged to be connected to an outlet flue communicating with the furnace such that the baffle means is located within the flow path of combustion gases through the flue, said baffle means being pivotally mounted to said support means for movement between an open position wherein the flow path through the flue is generally unimpeded and a closed position wherein a restricted flow path through the flue is provided, control means responsive to the temperature of the gases in the flue for moving said baffle means to the open position at a relatively low temperature indicating that the furnace is not operating and to its closed position at a relatively high temperature indicating that the furnace is operating whereby heat is retained in the furnace because of the restricted flow path, said baffle means including a pair of yoke members mounted for movement between the open and closed positions and louvre means pivotally carried by each of said yoke means.

2. A damper assembly in accordance with claim 1 wherein said baffle means is spaced from said support means when said baffle means is in said closed position so that the space therebetween provides a restricted flow path.

3. A damper assembly in accordance with claim 2 wherein said support means has a generally circular shape and said baffle means define a generally circular shape in its closed position and wherein in the circular shape defined by said baffle means is of a smaller diameter than the diameter of said support means.

4. A damper assembly in accordance with claim 1 wherein each of said louver means comprises a single louver member pivoted adjacent its upper end to its associated yoke member.

5. A damper assembly in accordance with claim 1 wherein each of said louver means comprises a plurality of louver members pivoted adjacent their upper ends to their associated yoke member.

6. A damper assembly in accordance with claim 1 including stop means preventing movement of said baffle means in one direction from the closed position.

7. A damper assembly in accordance with claim 1 wherein said support means comprises an annular ring member.

8. A damper assembly in accordance with claim 1 wherein said support means comprises a generally cylindrical sleeve member.

9. A damper assembly in accordance with claim 1 wherein said support means comprises a first sleeve member and a second sleeve member telescopically received in said first sleeve member and spring means biasing said sleeve members apart.

10. A damper assembly in accordance with claim 1 wherein said control means includes a bimetallic helical spring.

11. A damper assembly in accordance with claim 10 wherein said control means further includes an inner shaft and an outer concentric sleeve, one end of said spring being fixed to said shaft and the other end of said spring being fixed to said sleeve whereby said shaft and said sleeve are rotated in opposite directions as said spring expands and contracts.

12. A damper assembly in accordance with claim 11 wherein said baffle means includes a pair of yoke members and wherein one of said yoke members is keyed to said shaft and the other of said yoke members is keyed to said sleeve.

13. A damper assembly in accordance with claim 10 wherein said conrol means further includes a rotatable shaft one end of which is keyed to said spring and wherein the other end of said spring is fixed to said support means, one end of said shaft carrying a driver gear for rotating said baffle means.

14. A damper assembly in accordance with claim 13 wherein said driver gears drives a pair of shafts in opposite directions, each of said shafts carrying a baffle member.

15. A damper assembly in accordance with claim 1 including a check damper means responsive to said control means whereby said check damper means is open when said baffle means is closed and is closed when said baffle means is open.

16. A damper assembly for conserving fuel consumption in a furnace comprising baffle means and support means in which said baffle means is located, said support means being arranged to be connected to an outlet flue communicating with the furnace such that the baffle means is located within the flow path of combustion gases through the flue, said baffle means being pivotally mounted to said support means for movement between an open position wherein the flow path through the flue is generally unimpeded and a closed position wherein a restricted flow path through the flue is provided, control means responsive to the temperature of the gases in the flue for moving said baffle means to the open position at a relatively low temperature indicating that the furnace is not operating and to its closed position at a relatively high temperature indicating that the furnace is operating whereby heat is retained in the furnace because of the restricted flow path, said support means comprising a first sleeve member and a second sleeve member telescopically received in said first sleeve member and spring means biasing said sleeve members apart.

17. A damper assembly for conserving fuel consumption in a furnace comprising baffle means and support means in which said baffle means is located, said support means being arranged to be connected to an outlet flue communicating with the furnace such that the baffle means is located within the flow path of combustion gases through the flue, said baffle means being pivotally mounted to said support means for movement between an open position wherein the flow path through the flue is generally unimpeded and a closed position wherein a restricted flow path through the flue is provided, control means responsive to the temperature of the gases in the flue for moving said baffle means to the open position at a relatively low temperature indicating that the furnace is not operating and to its closed position at a relatively high temperature indicating that the furnace is operating whereby heat is retained in the furnace because of the restricted flow path, said control means including a bimetallic helical spring, said control means further including an inner shaft and an outer concentric sleeve, one end of said spring being fixed to said shaft and the other end of said spring being fixed to said sleeve whereby said shaft and said sleeve are rotated in opposite directions as said spring expands and contracts.

18. A damper assembly in accordance with claim 17 wherein said baffle means includes a pair of yoke members and wherein one of said yoke members is keyed to said shaft and the other of said yoke members is keyed to said sleeve.

19. A damper assembly for conserving fuel consumption in a furnace comprising baffle means and support means in which said baffle means is located, said support means being arranged to be connected to an outlet flue communicating with the furnace such that the baffle means is located within the flow path of combustion gases through the flue, said baffle means being pivotally mounted to said support means for movement between an open position wherein the flow path through the flue is generally unimpeded and a closed position wherein a restricted flow path through the flue is provided, control means responsive to the temperature of the gases in the flue for moving said baffle means to the open position at a relatively low temperature indicating that the furnace is not operating and to its closed position at a relatively high temperature indicating that the furnace is operating whereby heat is retained in the furnace because of the restricted flow path, said control means including a bimetallic helical spring and a rotatable shaft one end of which is keyed to said spring, the other end of said spring being fixed to said support means, one end of said shaft carrying a driver gear for rotating said baffle means.

20. A damper assembly in accordance with claim 19 wherein said driver gears drive a pair of shafts in opposite directions, each of said shafts carrying a baffle member.

21. A damper assembly for conserving fuel consumption in a furnace comprising baffle means and support means in which said baffle means is located, said support means being arranged to be connected to an outlet flue communicating with the furnace such that the baffle means is located within the flow path of combustion gases through the flue, said baffle means being pivotally mounted to said support means for movement between an open position wherein the flow path through the flue is generally unimpeded and a closed position wherein a restricted flow path through the flue is provided, control means responsive to the temperature of the gases in the flue for moving said baffle means to the open position at a relatively low temperature indicating that the furnace is not operating and to its closed position at a relatively high temperature indicating that the furnace is operating whereby heat is retained in the furnace because of the restricted flow path, and check damper means responsive to said control means whereby said check damper means is open when said baffle means is closed and is closed when said baffle means is open.

* * * * *